United States Patent [19]

Kurokawa

[11] Patent Number: 4,889,271

[45] Date of Patent: Dec. 26, 1989

[54] FEED ROLLER

[75] Inventor: Toshio Kurokawa, Tokyo, Japan

[73] Assignee: Fuji Photo Film Co., Ltd., Kanagawa, Japan

[21] Appl. No.: 123,467

[22] Filed: Nov. 20, 1987

[30] Foreign Application Priority Data

Dec. 2, 1986 [JP] Japan ..... 61-185888

[51] Int. Cl.[4] ..... B65H 20/02

[52] U.S. Cl. ..... 226/186; 226/191; 226/193

[58] Field of Search ..... 226/190, 191, 193, 186, 226/189; 242/68.5, 76

[56] References Cited

U.S. PATENT DOCUMENTS

| | | | |
|---|---|---|---|
| 3,170,576 | 2/1965 | Frank | 226/191 X |
| 3,187,409 | 6/1965 | Glass | 226/191 X |
| 3,235,940 | 2/1966 | Taylor et al. | 226/190 X |
| 3,493,161 | 3/1970 | Billings | 226/190 |
| 4,544,253 | 10/1985 | Kummerl | 226/190 X |

FOREIGN PATENT DOCUMENTS

| | | | |
|---|---|---|---|
| 98050 | 7/1980 | Japan | 226/191 |
| 515146 | 5/1976 | U.S.S.R. | 226/191 |
| 776400 | 6/1957 | United Kingdom | 226/193 |

OTHER PUBLICATIONS

"A Soft Touch Surface Designed for Scratch-Free Motion-Picture Film Processing", C. J. Crane, W. L. Stogkdale & L. R. Witherow, Eastman Kodak Co., J. SMPTE 79/No. 8/712-715 (1970).

*Primary Examiner*—Joseph J. Hail III

*Attorney, Agent, or Firm*—Sughrue, Mion, Zinn, Macpeak & Seas

[57] ABSTRACT

A feed roller having a hard roller body and a cylindrical resilient cover member fitted onto the hard roller body. The feed roller has internal contact portions formed on an inner surface of the cover member, the internal contact portions being kept in contact with the outer periphery of the roller body when the cover member is fitted onto the roller body; external contact portions formed on an outer surface of the cover member so as to project outwardly in the radial direction of the cover member; and spaces defined between the inner surfaces of the external contact portions and the outer periphery of the roller body. Accordingly, the cover member can easily be attached to the roller body and enables objects to be fed by a small clamping reaction force, thereby preventing the objects from being damaged.

11 Claims, 7 Drawing Sheets

FEED ROLLER

BACKGROUND OF THE INVENTION

1. Field of the Invention

The present invention relates to a feed roller suitable for use in feeding a sheet-like object in a clamped manner.

2. Description of the Related Art

In general, feeder arrangements of the type employing rollers are utilized in various fields which necessitate the feeding of sheet-like objects. For instance, in the field of photographic development, such a feeder arrangement is incorporated in automatic development machines as a means of causing a long photographic film to pass through a series of processing baths.

In this case, the surface of the film that comes into contact with rollers, in particular, the emulsion bearing surface of the film that is exposed to development, requires careful handling because of its sensitivity. For this reason, it has been common practice to attach a protective material such as MOLTEN (tradename) to the periphery of each roller in order to protect the emulsion bearing surface of the film.

Such a protective material, however, involves the following problems. Attachment of the protective material to the body of each roller is time-consuming and, in addition, provision of the protective material amounts to a significant expense. When the film is to be fed while being nipped between pairs of rollers, the gap between the rollers is preferably made as narrow as possible in order to allow the film to be nipped therebetween. On the other hand, from the viewpoint of protection of the emulsion bearing surfaces, the gap between the rollers is preferably made wide so as to reduce the level of clamping reaction force applied to these surfaces. Accordingly, in order to suitably maintain the clamping force applied to the film, it has been necessary to adjust the sizes of the respective gaps between opposing rollers.

SUMMARY OF THE INVENTION

It is therefore an object of the present invention to provide an improved feed roller which is easy to assemble and which is capable of positively feeding a sheet-like object without damaging it because of its small clamping reaction force.

The above object is achieved by the present invention which provides a feed roller for feeding an object in a clamped manner comprising a hard roller body; a cylindrical resilient cover member fitted onto the hard roller body; an internal contact portion formed on an inner surface of the cover member, the internal contact portion being kept in contact with the outer periphery of the hard roller body when the cover member is fitted onto the hard roller body; an external contact portion formed on an outer surface of the cover member so as to project outwardly in the radial direction of the cover member; and a space portion which defines a space between the inner surface of the external contact portion and the outer periphery of the hard roller body.

In accordance with the present invention, an improved feed roller is provided having external contact portions formed to abut against a sheet-like object. The improved feed roller includes a plurality of spaces that are defined along the periphery of its body by space portions of a cover member fitted onto the body so as to impart a suitable degree of resiliency to the cover member. Accordingly, the sheet-like object is positively fed by the resultant small clamping reaction force arising from the cover member, thereby preventing the object from being damaged. In addition, the inventive feed roller can easily be assembled since only internal contact portions of the cover member are brought into intimate contact with the periphery of the body.

DESCRIPTION OF THE PREFERRED EMBODIMENTS

Figure 1:
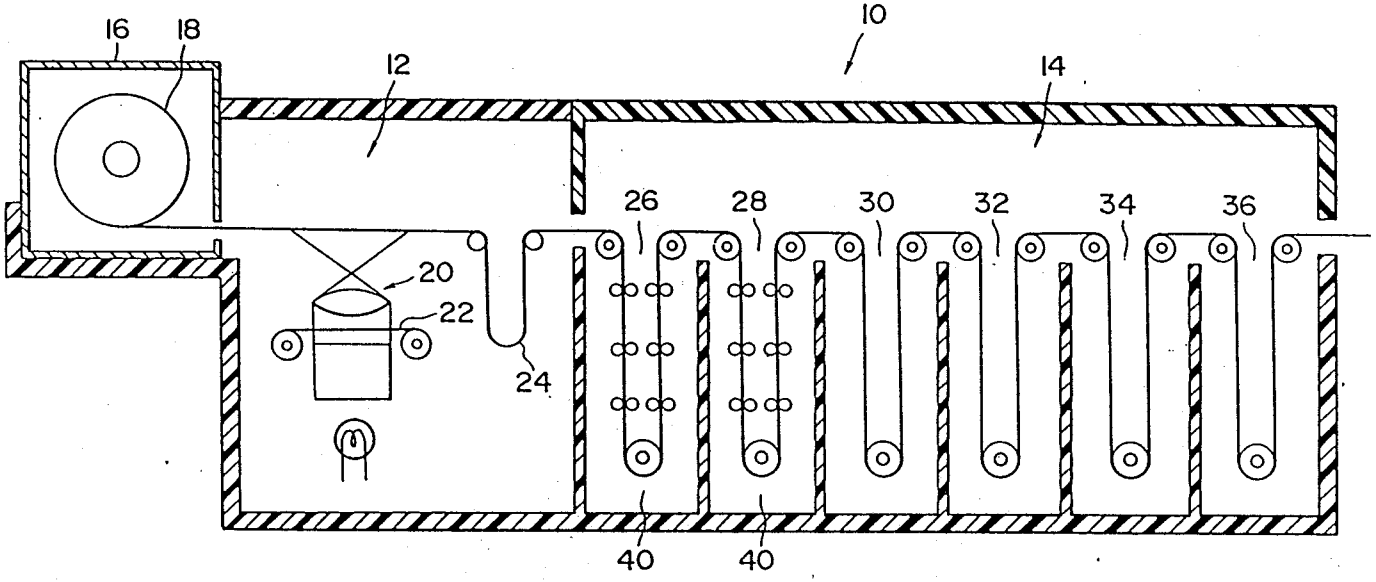
FIG. 1 is a diagrammatic longitudinal section of an automatic development machine which incorporates a plurality of feed rollers constituting a first preferred embodiment of the present invention.

FIG. 1 is a diagrammatic longitudinal section of an automatic development machine which incorporates a plurality of feed rollers each constituting a first preferred embodiment of the present invention. An automatic development machine indicated generally at 10 includes an upstream section serving as an exposure section 12 (the left-hand portion in FIG. 1) and a downstream section serving as a development section 14 (the right-hand portion in FIG. 1).

A roll of photographic paper 18 is accommodated in a magazine 16 of the exposure section 12. A predetermined length of the photographic paper 18 is supplied sequentially from the outer circumference of the roll toward the optical axis of optical means 20. The thus-supplied portion of the photographic paper 18 is then exposed to an image or images on a negative film 22 by the optical means 20. The exposed portion of the photographic paper 18 is fed to the development section 14 via a buffer-loop forming section 24 which is designed to absorb a difference between the feed speeds of the photographic paper 18 in the exposure section 12 and the development section 14.

The development section 14 includes a development bath 26, a bleaching bath 28, a fixation bath 30, a washing bath 32, and a stabilization bath 34, and each of these processing baths is charged with a predetermined processing liquid. The exposed portion of the photographic paper 18 is developed as it passes through these processing baths. Although not specifically shown, each of the processing baths includes means for agitating and circulating the processing liquid therein. The thus-developed portion of the photographic paper 18 is dried in a drying chamber 36 and is then discharged therefrom.

A development rack indicated generally at 40 is accommodated in each of the processing baths. The photographic paper 18 is guided over rollers supported by the development rack 40 in each of the processing liquids filled in the above-described processing baths.

Figure 2:
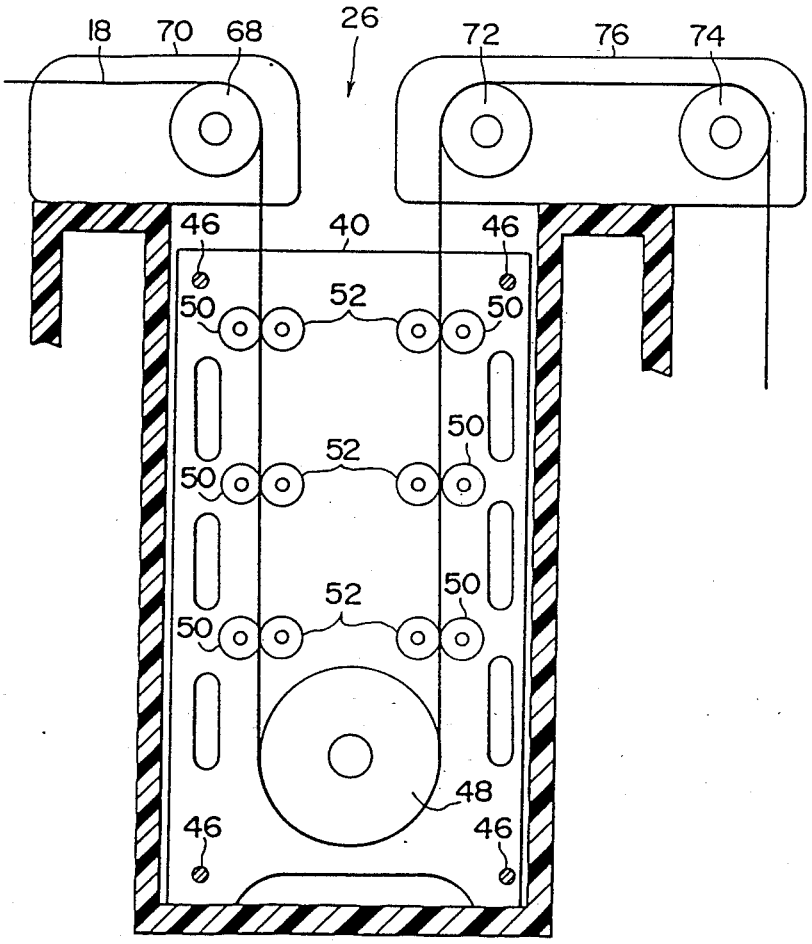
FIG. 2 is an enlarged diagrammatic longitudinal section of a development bath provided in the automatic development machine shown in FIG. 1.
Figure 3:
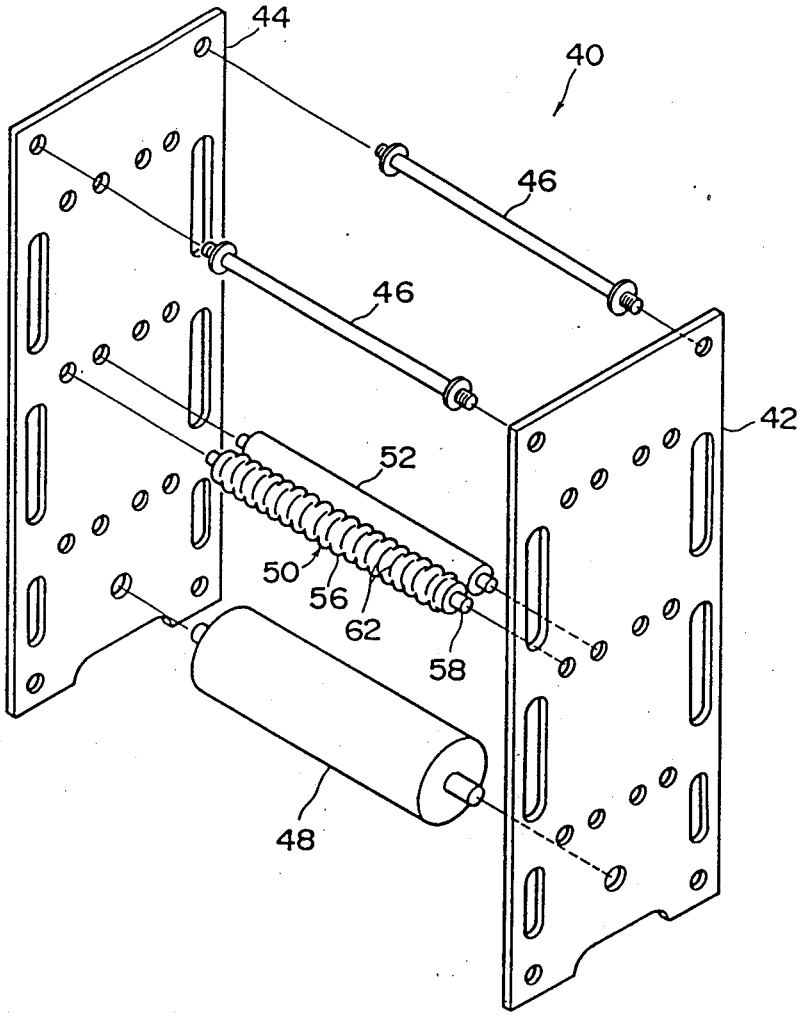
FIG. 3 is a diagrammatic explosion showing in perspective a development rack including feed rollers of the invention.

As shown in FIGS. 2 and 3, the development rack 40 includes a pair of rack side plates 42 and 44 which are firmly connected parallel to each other by a plurality of shafts 46. A support roller 48 is supported for rotation about its longitudinal axis by portions near the lower ends of the rack side plates 42 and 44, and the photographic paper 18 is partially wound around the support roller 48 and is looped back upward thereby in the vicinity of the bottom of each of the processing baths.

Pairs of a feed roller 50 of the present invention and a conventional type feed roller 52 are rotatably supported by the rack side plates 42 and 44 so as to guide the photographic paper 18 in each of the processing baths. For the sake of simplification of the subsequent description, FIG. 3 illustrates one pair of the feed rollers 50 and 52. The feed rollers 50 are arranged in a face-to-face relationship with one surface of the photographic paper 18 as it is being moved through the processing baths, that is, with the outer surface of the portion of the photographic paper 18 which is looped back by the support rollers 48.

Figure 4:
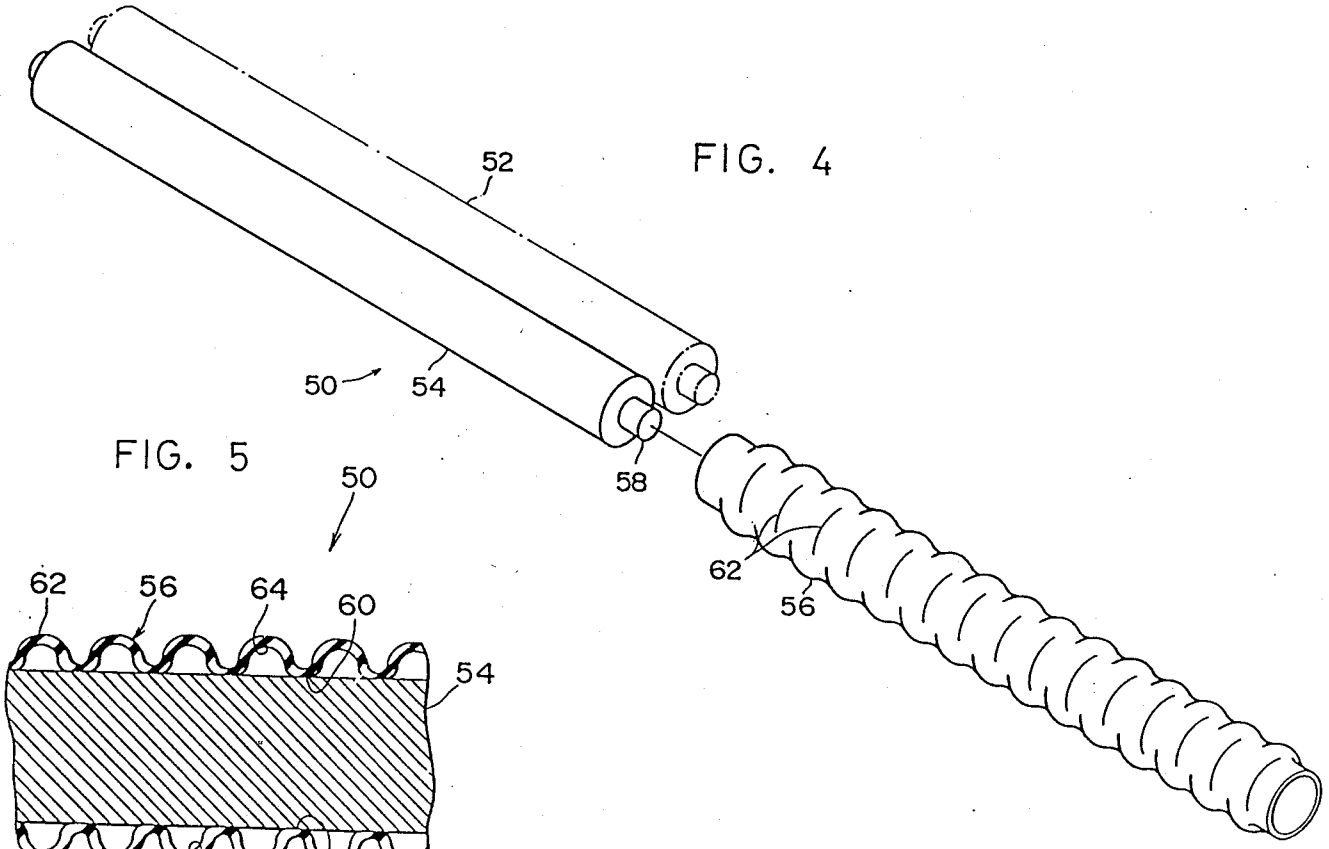
FIG. 4 is an enlarged perspective view of the first preferred embodiment of the feed roller in accordance with the present invention.
Figure 5:
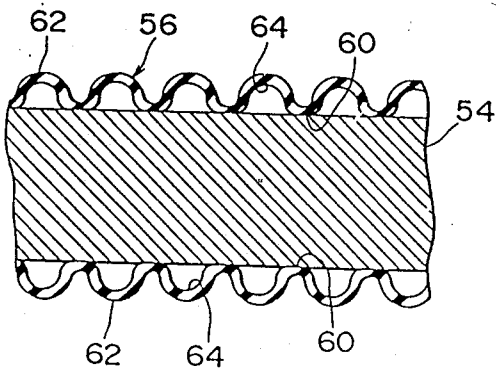
FIG. 5 is a fragmentary cross section of the body and cover member which constitute in combination the first embodiment.

As shown in FIGS. 3, 4 and 5, the feed rollers 50 are each constituted by a body 54 and a cover member 56. The body made of a hard material has a cylindrical form, and has a central shaft 58 which extends along the longitudinal axis of the body. The feed roller 50 is supported at the opposite ends of the shaft 58 for rotation about its longitudinal axis between the rack side plates 42 and 44. The cover member 56 is fitted onto the periphery of the body 54.

The cover member 56 having a bellows-like form is blow-molded with a thermoplastic elastomer. As shown in FIG. 5, the inner diameter of each internal contact portion 60 is equal to or slightly smaller than the outer diameter of the body 54. External contact portions 62 project outwardly of the cover member 56 extending continuously from each of the internal contact portions 60 to form a series of annular ridges. The feed rollers 50 and 52 are disposed parallel to each other in such a manner that the external contact portions 62 abut against or are spaced slightly apart from the periphery of the feed roller 52. The cover member 56 can be resiliently deformed along its longitudinal axis and in its radial direction. Accordingly, the cover member 56 can be readily fitted onto the body 54.

The cover member 56 has space portions 64 which define a plurality of spaces between the periphery of the body 54 and the inner surface of the cover member 56. Therefore, when fitted onto the body 54, the cover member 56 can be provided with a suitable degree of resiliency. Accordingly, while the photographic paper 18 is being guided and fed through the nips between the cover members 56 on the feed rollers 50 and the associated feed rollers 52, the emulsion bearing surface of the photographic paper 18 is clamped by a suitable level of reaction force arising from the cover members 56.

A support roller 68 is supported for rotation about its axis by a bracket 70 on the top of the development bath 26 so that the photographic paper 18 supplied from the exposure section 12 may be partially wound around the support roller 68 and be then looped downward into the development bath 26. In addition, support rollers 72 and 74 are supported for rotation about its axis by a bracket 76 so as to feed the photographic paper 18 from the development bath 26 to the bleaching bath 28.

It is to be noted that the support rollers 48 and the feed rollers 50, 52 are rotated about their respective axes by a drive force of a motor (not shown) to feed the photographic paper 18 from the exposure section 12 to the development section 14 including the respective baths.

The following is a description of the operation of the first preferred embodiment.

The portion of the photographic paper 18 that is exposed to an image by the optical means 20 is fed to the development section 14 with the emulsion bearing surface being faced down. In this case, the photographic paper 18 is partially wound around the support roller 68 and is looped downward thereby. Subsequently, the photographic paper 18 is sequentially passed through the nips between the feed rollers 50 and 52. The emulsion bearing surface of the photographic paper 18 corresponds to the feed rollers 50 and therefore the external contact portions 62 on the cover members 56 come into contact with the emulsion bearing surface. As described previously, a plurality of spaces are defined along the periphery of each of the bodies 54 by the space portions 64 of the cover member 56 fitted onto the body 54, thereby imparting a suitable degree of resiliency to the cover members 56. Accordingly, the cover members 56 are caused to abut against the emulsion bearing surface of the photographic paper 18 by the resultant small clamping reaction force, thereby preventing the emulsion bearing surface from being damaged.

The following is a description of a second preferred embodiment of the present invention. In the second embodiment, like numerals are used to denote the like or corresponding elements relative to those in the above-described first embodiment, and the detailed description thereof will be omitted.

Figures 6, 7:
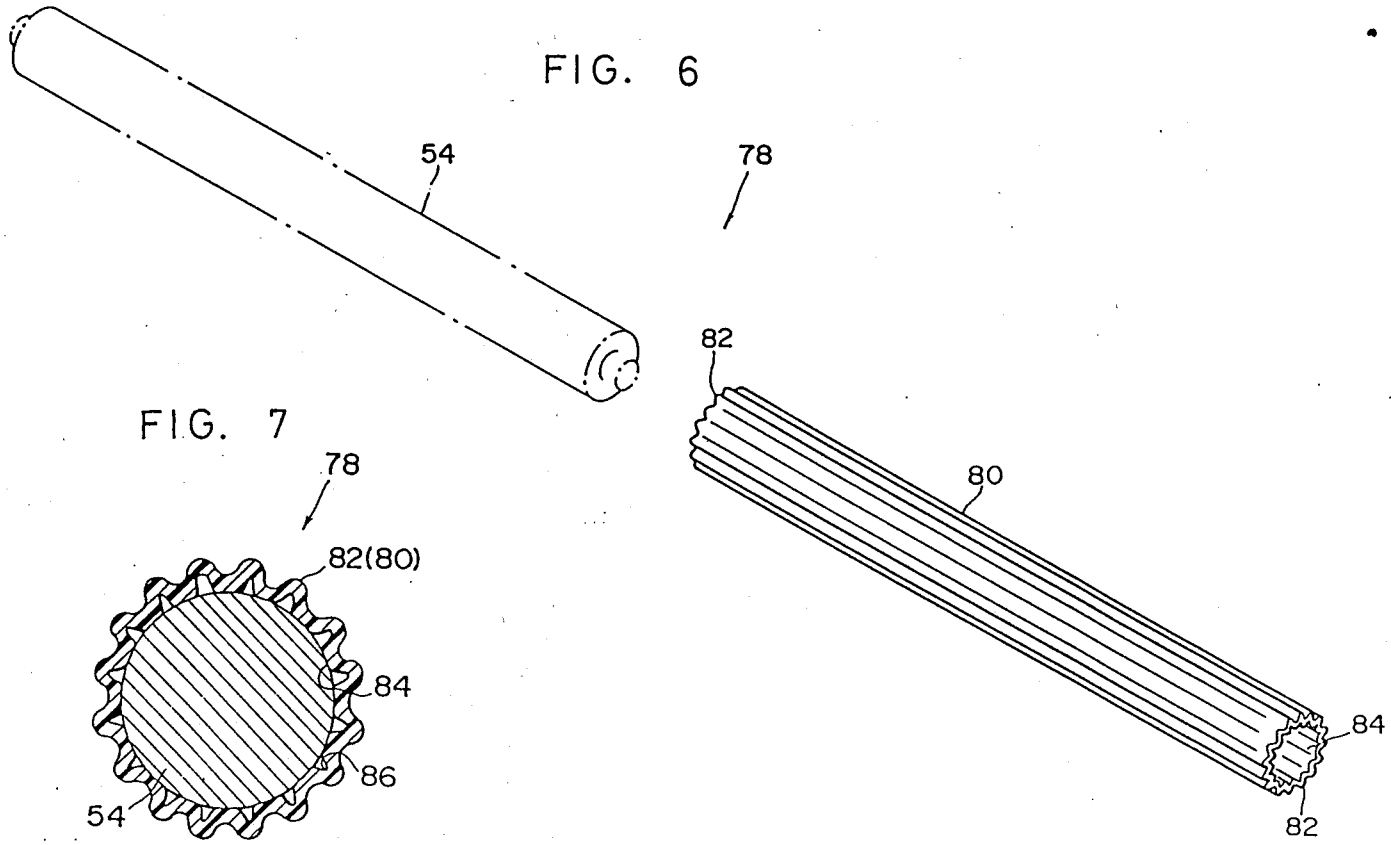
FIG. 6 is an enlarged perspective view of a second preferred embodiment of the feed roller in accordance with the present invention.
FIG. 7 is a fragmentary cross section of the second embodiment of the feed roller.

FIGS. 6 and 7 illustrate the second embodiment of the present invention. Similar to the feed roller 50 used in the first embodiment, a feed roller indicated generally at 78 includes the body 54, and a cover member 80 is fitted onto the body 54. The cover member 80, which is produced by extruding a thermoplastic elastomer, has a plurality of projecting external contact portions 80 which extend along the longitudinal axis of the cover member 80 and which are formed in equally spaced apart relationship around the circumference thereof. The inner diameter around which the internal contact portions 84 are located is equal to or slightly smaller than the outer diameter of the body 54. The cover member 80 has space portions 86 which define a plurality of spaces between the periphery of the body 54 and the inner surface of the cover member 84. Therefore, when fitted onto the body 54, the cover member 84 can be provided with a suitable degree of resiliency.

In the second embodiment as well, while the photographic paper 18 is being guided and fed through the nips between the cover members 80 on the feed rollers 78 and the associated feed rollers 52, the emulsion bearing surface of the photographic paper 18 is clamped by a suitable level of reaction force arising from the cover members 80 without being damaged. In addition, the cover member 80 according to the second embodiment has a simple form and can be readily produced by extrusion.

It is to be noted that the material of the cover member 80 is not limited solely to an extruded thermoplastic elastomer and, for example, an injection-molded thermoplastic elastomer or a press-molded synthetic rubber material may be employed.

Figure 8:
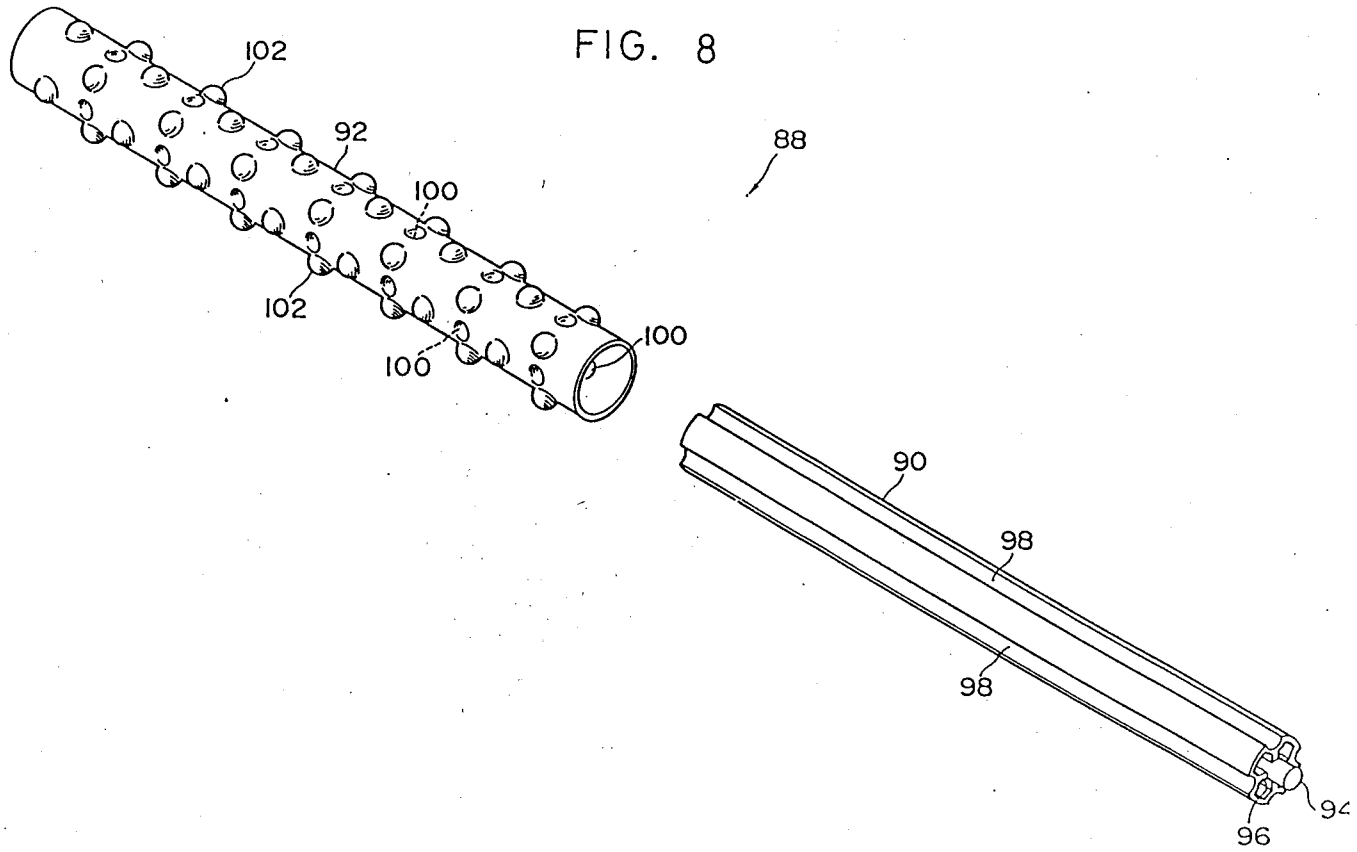
FIG. 8 is an enlarged perspective view of a third preferred embodiment of the feed roller in accordance with the present invention.
Figure 9:
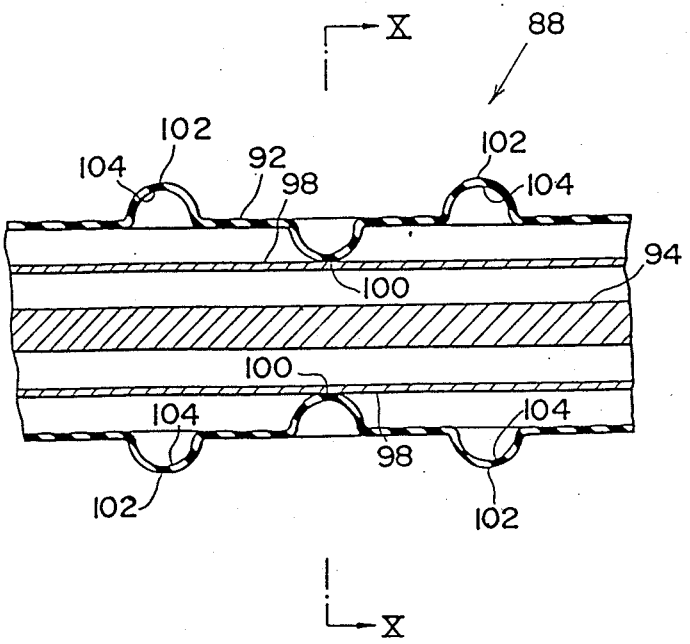
FIG. 9 is a fragmentary cross section of the third embodiment of the feed roller.
Figure 10:
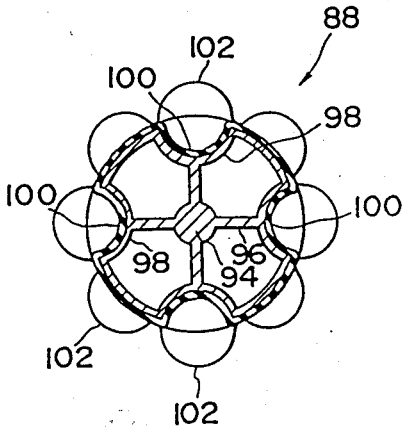
FIG. 10 is a cross section taken along line X—X of FIG. 9.

FIGS. 8, 9 and 10 illustrate a third preferred embodiment of the present invention. A feed roller indicated generally at 88 includes a body 90 and a cover member 92. The body 90 has a substantially cylindrical form, and a central shaft 94 is fixed to radial stays 96 extending along the longitudinal axis of the body 90. A plurality of axially extending recesses 90 are formed in the periphery of the body 90.

The cover member 92 is formed of a thermoplastic elastomer, and a plurality of projections 100 project inwardly from the inner circumference of the cover member 92. The projections 100 are formed in lines corresponding to the axially extending recesses 98 formed in the body 90, and each line of the spherical projections 100 is adapted to engage with the corresponding recess 98. Accordingly, after the cover member 92 has been fitted onto the body 90, the cover member 92 is prevented from shifting circumferentially about the body 90.

A plurality of projections 102 serving as external contact portions are formed on the periphery of the cover member 92. As shown in FIG. 9, the projections 102 each have a hollow form with a space portion 104 so that a suitable degree of resiliency is generated in the projections 102. Accordingly, while the photographic paper 18 is being guided and fed through the nips between the cover members 92 on the feed rollers 88 and the associated feed rollers 52, the emulsion bearing surface of the photographic paper 18 is clamped by a suitable level of reaction force arising from the cover members 92, thereby preventing the emulsion bearing surface from being damaged. In addition, each line of the projections 100 on the cover member 92 is adapted to engage with the corresponding recess 98. Accordingly, after the cover member 92 has been fitted onto the body 90, the cover member 92 is prevented from shifting circumferentially about the body 90 to ensure that the cover member 92 is further positively fitted onto the body 54.

In the above-described first and second embodiments, the feed rollers of the present invention are applied to the automatic development machine 10 by way of example. However, this usage is illustrative and not restrictive. For example, the present invention is applicable to sheet feed or discharge rollers in a copying machine.

In addition, the material of the cover member is not limited to a thermoplastic elastomer. For example, a resilient material such as a synthetic rubber or a synthetic resin may be employed.

What is claimed is:

1. A feed roller for feeding an object in a clamped manner, comprising:

a hard roller body having a longitudinal axis and recesses which extend along said longitudinal axis and which are spaced apart around the circumference of said hard roller body;

a cylindrical resilient cover member fitted onto said hard roller body and having a longitudinal axis;

an internal contact portion formed on an inner surface of said cover member, said internal contact portion comprising second projections on said resilient cover member with a plurality of said second projections extending inwardly into engagement with each of said recesses and with said second projections being kept in contact with the recesses in the outer periphery of said hard roller body when said cover member is fitted onto said hard roller body;

an external contact portion formed on an outer surface of said cover member so as to project outwardly in the radial direction of said cover member, said external contact portion comprising at least two first hemispherical projections formed on the outer periphery of said cover member and convex in a direction substantially perpendicular to said longitudinal axis, said two first projections being spaced apart in a first direction substantially parallel to said longitudinal axis of said cover member by a distance less than the width of said object in said first direction; and a space portion which defines a space between the inner surface of said external contact portion and the outer periphery of said hard roller body.

2. A feed roller according to claim 1, wherein said hard roller body has recesses which extend along the longitudinal axis of said hard roller body and which are spaced apart around the circumference of said hard roller body, and said cover member has second projections which extend inwardly into engagement with said recesses.

3. A feed roller for feeding an object in a clamped manner, comprising:

a hard roller body having a longitudinal axis, said body having recesses extending along the longitudinal axis of said body and being spaced apart around the circumference of said body;

a cylindrical resilient cover member fitted onto said hard roller body, said cover member having a longitudinal axis;

an external contact portion formed on an outer surface of said cover member so as to project outwardly in the radial direction of said cover member, said external contact portion comprising at least two first projections formed on the outer periphery of said cover member, said two first projections being spaced apart in a first direction substantially parallel to said longitudinal axis of said cover member by a distance less than the width of said object in said first direction; and an internal contact portion formed on an inner surface of said cover member, said internal contact portion comprising second projections extending inwardly into engagement with said recesses with a plurality of said second projections engaging each of said recesses, said second projections being formed in lines parallel to the longitudinal axis of said cover member for engagement with said recesses and being kept in contact with the outer periphery of said hard roller body when said cover member is fitted onto said hard roller body; and a space portion which defines a space between the inner surface of said external contact portion and the outer periphery of said hard roller body.

4. A feed roller according to claim 3, wherein a plurality of said first projections are formed in lines parallel to the longitudinal axis of said cover member, said lines being spaced apart at predetermined intervals around the circumference of said cover member.

5. A feed roller according to claim 3, wherein said first and second projections have a substantially hemispherical form.

6. A feed roller suitable for use in feeding a sheet-like long object in a clamping manner, comprising:

a roller body of a hard material having a cylindrical form and a longitudinal axis and having recesses which extend along said longitudinal axis and which are spaced apart around the circumference of said roller body, said roller body including an axially extending central shaft;

a resilient cover member having a substantially cylindrical form and fitted onto said roller body, said resilient cover member having a longitudinal axis;

an internal contact portion formed on an inner surface of said resilient cover member, said internal contact portion comprising substantially hemispherical second projections which are formed on said cover member in lines parallel to the longitudinal axis of said resilient cover member, with a plurality of said second projections extending inwardly into engagement with each of said recesses, said second projections being kept in contact with the recesses in said roller body when said resilient cover member is fitted onto said roller body;

an external contact portion formed on an outer surface of said resilient cover member so as to project outwardly in the radial direction of said resilient cover member, said external contact portion being maintained in contact with said sheet-like long object while said sheet-like long object is being fed in a clamped manner, said external contact portion comprising at least two first hemispherical projections formed on the outer periphery of said resilient cover member and convex in a direction substantially perpendicular to said longitudinal axis of said cover member, said first projections being spaced apart in a first direction substantially parallel to said longitudinal axis by a distance less than the width of said object in said first direction; and a space defined between the inner surface of said external contact portion and the outer periphery of said roller body.

7. A feed roller according to claim 6, wherein said roller body has recesses which extend along the longitudinal axis of said roller body and which are spaced apart around the circumference of said roller body, and said resilient cover member has second projections which extend inwardly into engagement with said recesses.

8. A feed roller according to claim 7, wherein each said projection has a substantially hemispherical form and wherein a plurality of said projections are formed in lines parallel to the longitudinal axis of said resilient cover member for engagement with said recesses.

9. A feed roller suitable for use in feeding a sheet-like long object in a clamping manner, comprising:

a roller body of a hard material having a cylindrical form, said roller body having a longitudinal axis and including an axially extending central shaft, said roller body having recesses extending along the longitudinal axis of said roller body and being spaced along the circumference of said roller body;

a resilient cover member having a substantially cylindrical form with a longitudinal axis and fitted onto said roller body;

an internal contact portion formed on an inner surface of said resilient cover member, said internal contact portion comprising projections extending inwardly into engagement with said recesses with a plurality of said projections engaging each said recess, said internal contact portion being kept in contact with the outer periphery of said roller body when said resilient cover member is fitted onto said roller body;

an external contact portion formed on an outer surface of said resilient cover member so as to project outwardly in the radial direction of said resilient cover member, said external contact portion being maintained in contact with said sheet-like long object while said sheet-like long object is being fed in a clamped manner, said external contact portion including at least two projections spaced apart in a first direction substantially parallel to said longitudinal axis of said cover member by a distance less than the width of said object in said first direction; and a space defined between the inner surface of said external contact portion and the outer periphery of said roller body.

10. A feed roller according to claim 9, wherein a plurality of said first projections are formed in lines parallel to the longitudinal axis of said cover member, said lines being spaced apart at predetermined intervals around the circumference of said resilient cover member.

11. A feed roller according to claim 9, wherein each said projection has a substantially hemispherical form.

* * * * *